US007895784B1

(12) United States Patent
Clark et al.

(10) Patent No.: US 7,895,784 B1
(45) Date of Patent: Mar. 1, 2011

(54) SIGN APPARATUS AND METHOD

(75) Inventors: Jeremy A. Clark, Minneapolis, MN (US); David Cheney, St. Paul, MN (US); Michael A. Whittier, Minneapolis, MN (US); Joseph R. Guggenberger, Elk River, MN (US)

(73) Assignee: Target Brands, Inc., Minneapolis, MN (US)

( * ) Notice: Subject to any disclaimer, the term of this patent is extended or adjusted under 35 U.S.C. 154(b) by 21 days.

(21) Appl. No.: 12/567,493

(22) Filed: Sep. 25, 2009

(51) Int. Cl.
*G09F 7/22* (2006.01)

(52) U.S. Cl. ..... 40/617; 40/603; 40/604; 40/605; 160/197

(58) Field of Classification Search ..... 40/538, 40/490, 591, 720, 721, 722, 765, 766, 617, 40/603, 604, 601, 486, 487, 488, 491; 52/38, 52/39, 63, 67; 434/367, 405, 428, 430, 365; 160/197, 202, 211, 222, 225
See application file for complete search history.

(56) References Cited

U.S. PATENT DOCUMENTS 3,696,537 A * 10/1972 Alleman ..... 40/511
4,063,614 A * 12/1977 Iven ..... 181/152
4,392,316 A 7/1983 Thomas
4,532,579 A 7/1985 Merryman
4,870,769 A 10/1989 Ogilvie
5,046,274 A 9/1991 David
5,092,066 A * 3/1992 Brewster ..... 40/617
5,274,938 A 1/1994 McDonald et al.
5,409,191 A 4/1995 Wenmaekers
5,423,142 A 6/1995 Douglas et al.
5,649,379 A 7/1997 Hoffman et al.
6,332,284 B1 12/2001 Tafforeau
6,490,818 B1 * 12/2002 Bramhall et al. ..... 40/491
6,981,350 B1 * 1/2006 Redmon ..... 52/646
7,086,190 B2 8/2006 Voluckas

* cited by examiner

*Primary Examiner*—Joanne Silbermann
*Assistant Examiner*—Shin Kim
(74) *Attorney, Agent, or Firm*—Fish & Richardson P.C.

(57) ABSTRACT

Some embodiments of sign assembly include a secondary sign that at least partially fits within a side cavity defined by a larger, primary sign. In particular embodiments, the primary sign includes an internal frame that defines a channel to receive a side portion of the secondary sign and thereby retain the secondary sign in a generally parallel, side-by-side configuration relative to the primary sign.

20 Claims, 6 Drawing Sheets

SIGN APPARATUS AND METHOD

TECHNICAL FIELD

This disclosure relates to a sign apparatus for displaying information, for example, in a retail store environment.

BACKGROUND

Display fixtures can be used in retail stores or other environments to present various products to consumers. The display fixtures can retain the product packages therein in view of the consumers. For example, cosmetics, greeting cards, fashion accessories, magazines, and other products are often displayed in trays or shelves of a designated display fixture. Such a display fixture can be arranged along an aisle in a store so that consumers walking by the display fixture can readily grasp selected products.

Some stores provide hanging signage to help consumers navigate between the various aisles or departments of the store. Such ceiling-mounted signage can indicate groups of products that are located in various aisles or areas of a store, thereby assisting consumers in navigating through the store. For example, a hanging sign may indicate that a particular area of the store is the home furnishings area. As another example, a hanging sign may indicate that an aisle includes particular pharmaceutical products. In some instances, navigation signage can be supported by or extend from an endcap of a display fixture. Endcaps can be positioned at the end of a store aisle and retain a particular set of products on display. Signage supported by or extending from an endcap can indicate products or groups of products located within a particular store aisle to allow consumers to easily navigate a store and readily locate a desired product.

Other signage relating to product or brand information also can be hung from the ceiling or mounted on walls. Some display fixtures include one or more signs that describe the type of products retained by the display fixture or describe various uses for products retained by the display fixture. The signage can also display other information relating to products, such as features of the product or price information. Such display signs are typically mounted so that a consumer may view the message from a distance. For example, the display sign may be hung from an area of the ceiling near the display fixture while the products are separately retained on the shelves of the display fixture.

SUMMARY

Some embodiments of sign assembly include a secondary sign that at least partially fits within a cavity defined by a larger, primary sign. In such embodiments, the primary sign includes an internal frame that defines a channel to receive a side portion of the secondary sign and thereby retain the secondary sign in a generally parallel, side-by-side configuration relative to the primary sign. As described below, in a number of embodiments, the primary sign has a substantially greater depth than the secondary sign, thereby creating primary and secondary sign surfaces on different planes. Moreover, in particular embodiments both the signs are toollessly mounted to a ceiling of a retail store environment so as to draw consumers' attention toward the primary and secondary sign surfaces on multiple planes.

These and other embodiments described herein may provide one or more of the following benefits. First, some embodiments of the sign apparatus include first and second signs suspended from a ceiling in a retail store environment in a manner that provides graphic images and text in different display planes. Such a configuration can attract the attention of consumers in the retail store environment. Second, the first sign of the sign apparatus can be larger in both height and depth so that a depth dimension is thereby formed between a front face of the first sign and a front face of the second sign. Optionally, a depth dimension is also formed between a rear face of the first sign and a rear face of the second sign. Third, in some embodiments, the second sign is partially disposed within an interior space of the first sign (e.g., inside an open side of the first sign defined by the first sign frame), the display apparatus can provide a three-dimensional and more aesthetically pleasing appearance for the display apparatus. Fourth, in those embodiments in which the sign apparatus provides the multiple display surfaces at different depth dimensions, the three-dimensional appearance will more readily attract the attention of consumers passing by the sign apparatus, thereby encouraging consumers to pay closer attention to product information, sales events, or other information conveyed by the display surfaces.

The details of one or more embodiments of the invention are set forth in the accompanying drawings and the description below. Other features, objects, and advantages of the invention will be apparent from the description and drawings, and from the claims.

DETAILED DESCRIPTION OF ILLUSTRATIVE EMBODIMENTS

Figure 1:
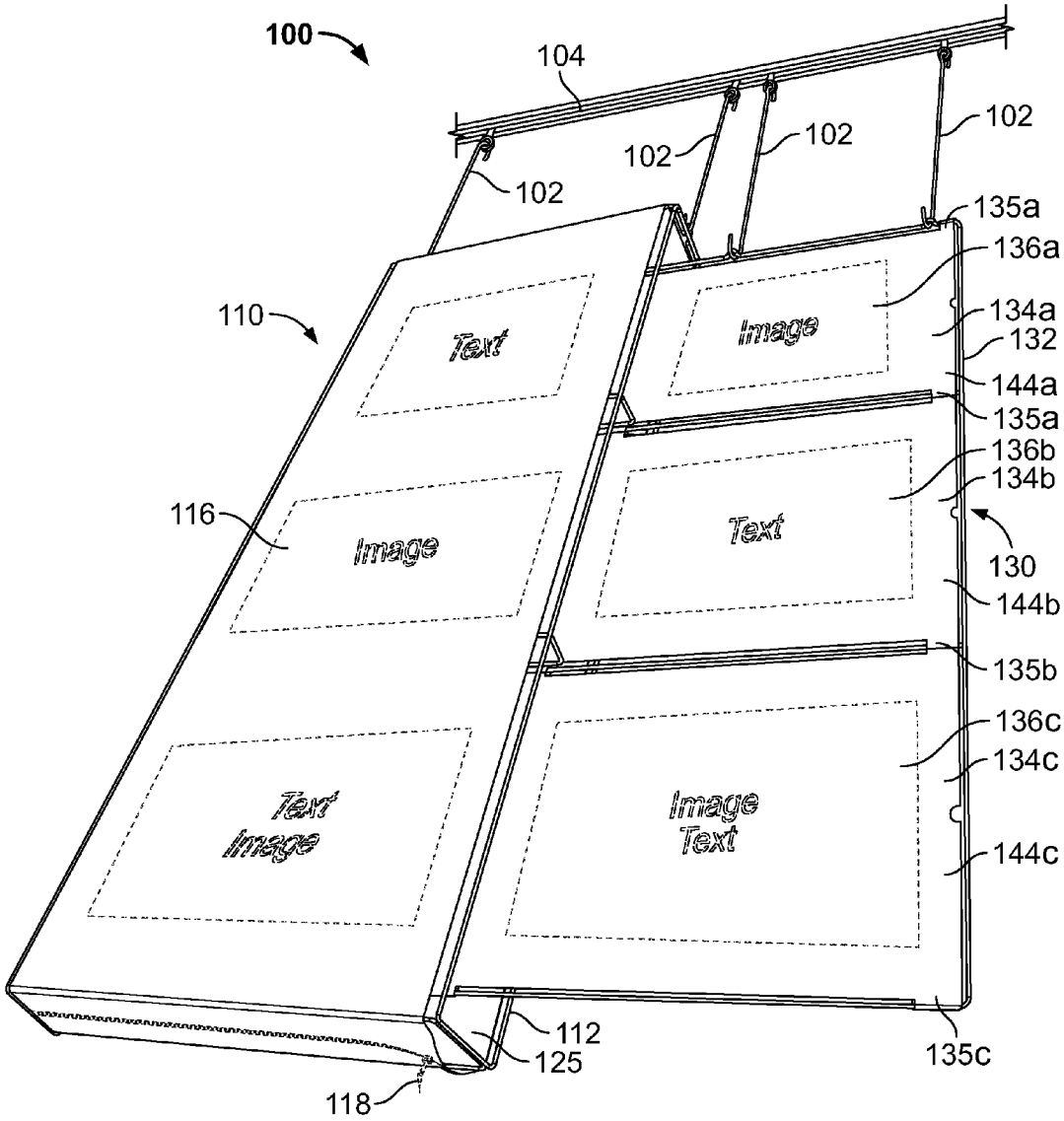
FIG. 1 is a perspective view of a display apparatus, in accordance with some embodiments.

Referring to FIG. 1, some embodiments of a display apparatus 100 include a first sign 110 and a second sign 130. The first and second signs 110 and 130 of the display apparatus 100 include signage portions bearing text and images indicative of, for example, products available in a retail store environment. In some embodiments, the display apparatus 100 is positioned in the retail environment, such as a consumer products store, in order to convey product information, sales information, or other information to consumers. In such embodiments, the display apparatus 100 is positioned near one or more shelves or other display fixtures holding products. The display apparatus 100 optionally conveys information related to the products displayed by the shelves or display fixtures. For example, the display apparatus 100 is positioned near shelves holding clothing and fashion accessories, and the display apparatus displays images of people wearing outfits made from the clothing and fashion accessories retained by the shelves. In other embodiments, the display apparatus includes text or images for enhancing the aesthetics of a retail environment.

Briefly, in use, the first and second signs 110 and 130 of the sign apparatus 100 are suspended from a ceiling track 104 in a manner to provide different display planes that attract the attention of consumers in a retail store environment. For example, both the signs 110 and 130 are toollessly mounted to the rail along the ceiling so as to draw attention from consumers in various parts of the retail store environment. In some embodiments, suspension members 102 are used to suspend the first and second signs 110 and 130 from the ceiling track 104. Moreover, in particular embodiments the second sign 130 in this embodiment partially fits within channels 124*a-b* (FIG. 2) defined by the larger, first sign 110. For example, the first sign 110 includes an internal frame 112 that defines the channel 124*a-b* to receive a side portion of the second sign 130 and thereby retain the secondary sign 130 in a generally parallel, side-by-side configuration relative to the primary sign. The first sign 110 in this embodiment is larger in both height and depth, which forms a depth dimension between the display faces of the first sign 110 and the display faces of the second sign 130.

Still referring to FIG. 1, the first sign 110 in this embodiment includes a wire frame 112 that defines a three-dimensional prism and an interior space 125. In the depicted example, the wire frame 112 provides a generally box-shaped structure that at least partially defines the interior space 125. In some embodiments, the height of the wire frame 112 is substantially greater than the width of the wire frame 112 which is substantially greater than the depth of the wire frame 112. For example, in one embodiment the wire frame 112 is about five feet tall, about two feet wide, and about six inches deep. In other embodiments the wire frame 112 is between about three feet tall and about seven feet tall, between about one foot wide and about five feet wide, and between about three inches deep and about eighteen inches deep.

In some embodiments, the first sign 110 includes a web of material 114 disposed about the wire frame 112. The web of material 114 is made from a flexible material that wraps around the front, bottom, rear, and top portions of the wire frame 112 while leaving the side portions of the wire frame exposed. For example, the web of material 114 for the first sign 110 comprises a woven fabric material having an ink layer printed thereon to provide graphic images and text for conveying information. In other embodiments, the web of material 114 comprises a flexible plastic sheet, paper, cardboard, paper board, metal foil, or another flexible material. The ink layer on the web of material 114 provides the graphic images and text on both a front face 116 and a rear face (not shown in FIG. 1) of the first sign 110. For example, the display apparatus 100 is located in a retail environment (e.g. a store) and the front face 116 includes text and graphics related to products located near the display apparatus 100. As another example, the front face 116 displays information relating to sales promotions or product prices in a store. As yet another example, the front face 116 displays images to enhance the aesthetics of the display apparatus 100. In some embodiments, the rear face of the first sign 110 also includes similar graphic images and text so that similar information is conveyed to consumers on both sides of the display apparatus 100. Optionally, the top face, the bottom face, or both include graphic images and text for conveying information to consumers.

The web of material 114 is configured to be toollessly removed from the frame 112 so as to readily change the appearance of the display apparatus 100. In some embodiments, the web of material 114 is equipped with a zipper 118 located, for example, at the free ends of the web 114 which meet along the bottom face of the first sign 130. The zipper 118 allows a store worker or other user to easily remove the web of material 114 from the wire frame 112 by unzipping the zipper 118 and unwrapping the web of material 114 from the wire frame 112. This readily removable configuration for the web of material 114 allows the web of material 114 to be quickly and efficiently removed from the first sign 110 and replaced with a different web of material to create a new look for the display apparatus 100. For example, a spring themed web of material depicting images of flowers is replaced by a summer themed web of material depicting images of people playing at the beach. As another example, the web of material 114 is replaced to coincide with various holidays, such as removing a St. Patrick's Day themed web of material and replacing it with an Easter themed web of material. In some embodiments, rather than the zipper 118, the web of material 114 includes one or more buttons, snaps, or hooks for attaching ends of the web of material 114 when the web of material 114 is wrapped around the wire frame 112. In other embodiments, the free ends of the web of material 114 are optionally joined to provide a continuous loop of material, which is positioned about the wire frame 112 by sliding the web of material 114 over one of the sides of the wire frame 112.

Still referring to FIG. 1, in accordance with some embodiments, the second sign 130 includes a wire frame 132 that defines a shape having a depth that is substantially smaller than the depth of the first sign 110. For example, the wire frame 132 of the second sign 130 defines a generally two-dimensional rectangle while the wire frame 112 of the first sign 110 defines a generally three-dimensional rectangular prism. In some embodiments, the height of the wire frame 132 is substantially greater than the width of the wire frame 132. For example, in one embodiment, the wire frame 132 is about fifty-four inches tall and about 24 inches wide. As another example, the wire frame 132 is between about 54 inches tall and about 78 inches tall and between about 12 inches wide and about 60 inches wide. In some embodiments, the height of the wire frame 132 for the second sign 130 is less than the height of the wire frame 112 for the first sign 110, while the width of the wire frame 132 is approximately equivalent to the width of the wire frame 112.

In some embodiments, the second sign 130 includes one or more webs of material 134*a-c* that each has an ink layer thereon to provide graphic images or text that convey information to the consumers. In the embodiment depicted in FIG. 1, the second sign 130 includes webs of material 134*a-c* disposed within frame portions 144*a-c* of the wire frame 132. For example, each of the webs 134*a-c* comprises a woven fabric material that receives the ink layer on one or both sides thereof. Each of the webs 134*a-c* in this embodiment includes finger extensions 135*a-c* proximate to the outer corners of each web 134*a-c*. The finger extensions 135*a-c* are configured to engage with the wire frame 132 so as to retain the corresponding webs of material 134*a-c* in a generally taut condition between the portions of the wire frame 132. For example, each finger extension 135*a-c* is optionally configured to wrap around a horizontal arm of the wire frame 132 and releasably secure to itself in a toolless manner using, for example, a hook-and-loop fastener or a releasable adhesive. As such, a store worker or other user can readily remove some or all of the webs 134*a-c* in a toolless manner and install new webs on the second sign 130 to provide a different appearance for the second sign 130. In alternative embodiments, the webs of material 134*a-c* comprise flexible plastic sheets, paper, cardboard, paper board, metal foil, or another flexible material. In some instances, the webs of material 134*a-c* are attached to the wire frame 132 using mechanical fasteners, such as rivets, pins, or the like. In other instances, the finger extensions 135*a-c* of the webs of material 134*a-c* are tied to the wire frame 132. In alternative embodiments, the second sign 130 includes a single web of material that wraps around the front, bottom, rear, and top portions of the wire frame 132 while leaving side portions of the frame 132 exposed.

The webs of material 134*a-c* include front faces 136*a-c* that receive the ink layer for displaying information in the form of text and graphics. For example, the display apparatus 100 is located in a retail store and the front faces 136*a-c* depict images found on shirts or other apparel available for purchase from a shelf or retail display located near the display apparatus 100. As another example, the front faces 136*a-c* display images of products and the front face 116 displays one or more images of people using the products. In some embodiments, rear faces (not shown in FIG. 1) of the webs 134*a-c* also include images, text, or both. For example, the rear faces of the webs 134 optionally include substantially the same graphic images and text as the front faces 136*a-c* so that consumers on both sides of the second sign 130 will receive substantially similar information.

Still referring to FIG. 1, the second sign 130 of the display apparatus 100 is partially disposed within the interior space 125 of the first sign 110. As will be described in greater detail with reference to FIGS. 2-5, the wire frame 112 of the first sign 110 defines one or more retaining structures recessed within an exposed side of the first sign 110. For example, the retaining structures define one or more channels or female mating structures that are configured to receive a side portion of the second sign 130 (refer, for example, to FIG. 2). When the first and second signs 110 and 130 are suspended from the ceiling, the second sign 130 is inserted through the open side face of the first sign 110 and the internal retaining structures maintain the second sign 130 in a generally parallel, side-by-side position relative to the first sign 130. In this embodiment, the internal retaining structures comprise a set of channels 124*a-b* (FIG. 2) defined by the frame 112 of the first sign 110 that have a width sufficient to slideably receive a side portion of the second sign. In such circumstances, the channels 124*a-b* maintain the front faces 136*a-c* of the second sign 130 and the front face 116 of the first sign 110 in a generally parallel relation even when one or both of the signs 110 and 130 are impacted or otherwise moved.

In such circumstances, the first and second signs 110 and 130 of the sign apparatus 100 are suspended from a ceiling track 104 in a manner that provides graphic images and text in different display planes to thereby attract the attention of consumers in a retail store environment. As previously described, the first sign 130 in this embodiment is larger in both height and depth, which forms a depth dimension between the front face 116 of the first sign 110 and the front faces 136*a-c* of the second sign 130 (and, optionally, a similar depth dimension between the rear faces). Because the second sign 130 is partially disposed within the interior space 125 of the first sign 110, the display apparatus 100 provides a three-dimensional and more aesthetically pleasing appearance for the display apparatus 100. In some instances, the three-dimensional appearance will more readily attract the attention of consumers passing by the display apparatus 100 than a two-dimensional sign, thereby causing consumers to pay closer attention to product information, sales events, or other information conveyed by the display apparatus 100.

Referring now to FIGS. 2-5, the first and second signs 110 and 130 are shown with the web of material 114 and the webs of material 134*a-c* in hidden lines for illustrative purposes of showing internal structures of the first and second wire frames 112 and 132. The first wire frame 112 includes cross supports 122 for providing extra support to the structure of the wire frame 112. The wire frame 132 includes cross supports 142 that provide extra support to the structure of the wire frame 132 and also define the frame portions 144*a-c*. The wire frame 112 defines channels 124*a* and 124*b* within the interior space 125 along a side 120 of the wire frame 112. In this embodiment, the channels 124*a-b* are u-shaped channels defined by the wire frame 112 proximate to the open side of the first sign 110. It should be understood that, in other embodiments, the channels 124*a-b* optionally include a shape that is different from the u-shaped channels illustrated in FIGS. 2-5. As previously described, the channels 124*a-b* are configured to receive a side edge portion 140 of the second sign 130. The channels 124*a-b* align the second sign 130 in an operable position with respect to the first sign 110 with the side edge portion 140 disposed within the interior space 125 of the first sign 110. The second sign 130 has a height that is necessarily shorter than the height of the first sign 110 to allow the second sign 130 (as shown, for example, in FIG. 4) to be partially disposed within the interior space 125 defined by the wire frame 112.

In some embodiments, the first and second wire frames 112 and 132 include mounting portions 126 and 146 respectively for receiving the suspension members 102. In some embodiments, the suspension members 102 comprise flexible cables or wires that mate with the mounting portions 126 and 146 using hooks disposed at the ends thereof. The hooks allow a store worker to toollessly remove the display apparatus 100 from the suspension members 102 (e.g., without the use of handheld tools). This configuration enables a store worker to safely change the web of material 114 and/or the webs of material 134*a-c* while the first and second signs 110 and 130 are positioned on the ground, rather than hanging from the ceiling track 104. Accordingly, the process for removing and replacing the webs of material 114 and 134*a-c* can be accomplished in a safe and convenient manner without the use of handheld tools.

Still referring to FIGS. 2-5, the second sign 130 is capable of being removed from the first sign 110 to further simplify the removing and replacing of the webs of material 114 and 134*a-c*. The second sign 130 is detached by sliding the side edge portion 140 out of the u-shaped channels 124*a-b*. This configuration enables a store worker to readily separate the second sign 130 form the first sign 110 in a toolless manner before lowering the second sign 130 from the suspended position near the ceiling. Accordingly, the store worker can safely install or remove the apparatus 100 while standing on a ladder and without the need for operating handheld tools.

In some embodiments, the modular design of the display apparatus 100 allows the first and second signs 110 and 130 to be detached from each other and displayed separately. For example, the display apparatus 100 is removed from a first area of a retail store and placed in a second area of the retail store having more constrained space restrictions. In this example, the second sign 130 is removed from the first sign 110 and the first sign 110 is suspended from a support rail without the second sign 130 in order to accommodate the constrained space restrictions. As another example, the first and second signs 110 and 130 are detached and suspended from the ceiling track 104 in close proximity to each other in order to create a different three dimensional appearance for the display apparatus 100.

In some embodiments, the suspension members 102 are attached to the mounting portions 126 and 146 of the first and second signs 110 and 130 using fasteners. In other embodiments, the suspension members 102 comprise cable, rope, string, ribbon, or other flexible members, which are tied or otherwise coupled to the mounting portions 126 and 146 in order to suspend the first and second signs 110 and 130 from the ceiling track 104. Moreover, in alternative embodiments, the suspension members 102 optionally comprise rigid rods or other rigid members that are suspended from the ceiling track 104 and mate with the mounting portions 126 and 146 of the first and second frames 112 and 132. In this embodiment, the mounting portions 126 and 146 are formed by bent portions of the wire frames 112 and 132. In other embodiments, the mounting portions 126 and 146 optionally comprise eyelets or hooks mounted to the wire frames 112 and 132.

The suspension members 102 attached to the mounting portions 146 of the second wire frame 132 are longer than the suspension members 102 attached to the mounting portions 126 of the first wire frame 112. As such, the top of the second sign 130 is positioned lower from the ceiling than the top of the first sign 110 when the first and second signs 110 and 130 are suspended from the ceiling track 104. Furthermore, the height of the second wire frame 132 is such that the bottom of the second sign 130 is positioned above the bottom of the first sign 110 when the first and second signs 110 and 130 are suspended from the ceiling track 104. Such a configuration allows the open side 120 of the first sign 110 to receive the side edge portion 140 of the second sign 130 in the interior space 125 (FIG. 1) without the second sign 130 contacting the top or bottom edges of the first wire frame 112.

In some alternate embodiments, a second side 121 of the wire frame 112 that is opposed to the side 120 also includes channels similar in shape and size as the channels 124*a-b*. These channels arranged proximate to the second side 121 of the first sign 110 are configured to receive a side edge portion of a third sign (not shown) having a structure similar to the second sign 130. For example, the third sign includes a wire frame similar to the second wire frame 132 of the second sign 130 and one or more webs of material attached to the wire frame for displaying images and/or text to consumers. Such a configuration in which the first sign 110 receives the second sign 130 and a third sign (not shown) may provide a larger and attractive appearance for the display apparatus 100.

In some alternate embodiments, the display apparatus 100 includes one or more light sources (e.g. light bulbs, LEDs, or the like) disposed within the interior space 125 of the first sign 110. The light sources can provide a backlighting effect for the first sign 110. In such embodiment, the web of material 114 is composed of a translucent or semi-transparent material, such as cloth, or translucent plastic. In some instances, the backlighting effect will more effectively draw the attention of consumers to the display apparatus 100. Additionally, in some embodiments, the light sources are positioned so as to shed light on the webs of material 134*a-c* in order to make graphics and text displayed on the webs of material 134*a-c* more readily visible to consumers viewing the display apparatus 100.

Figure 6:
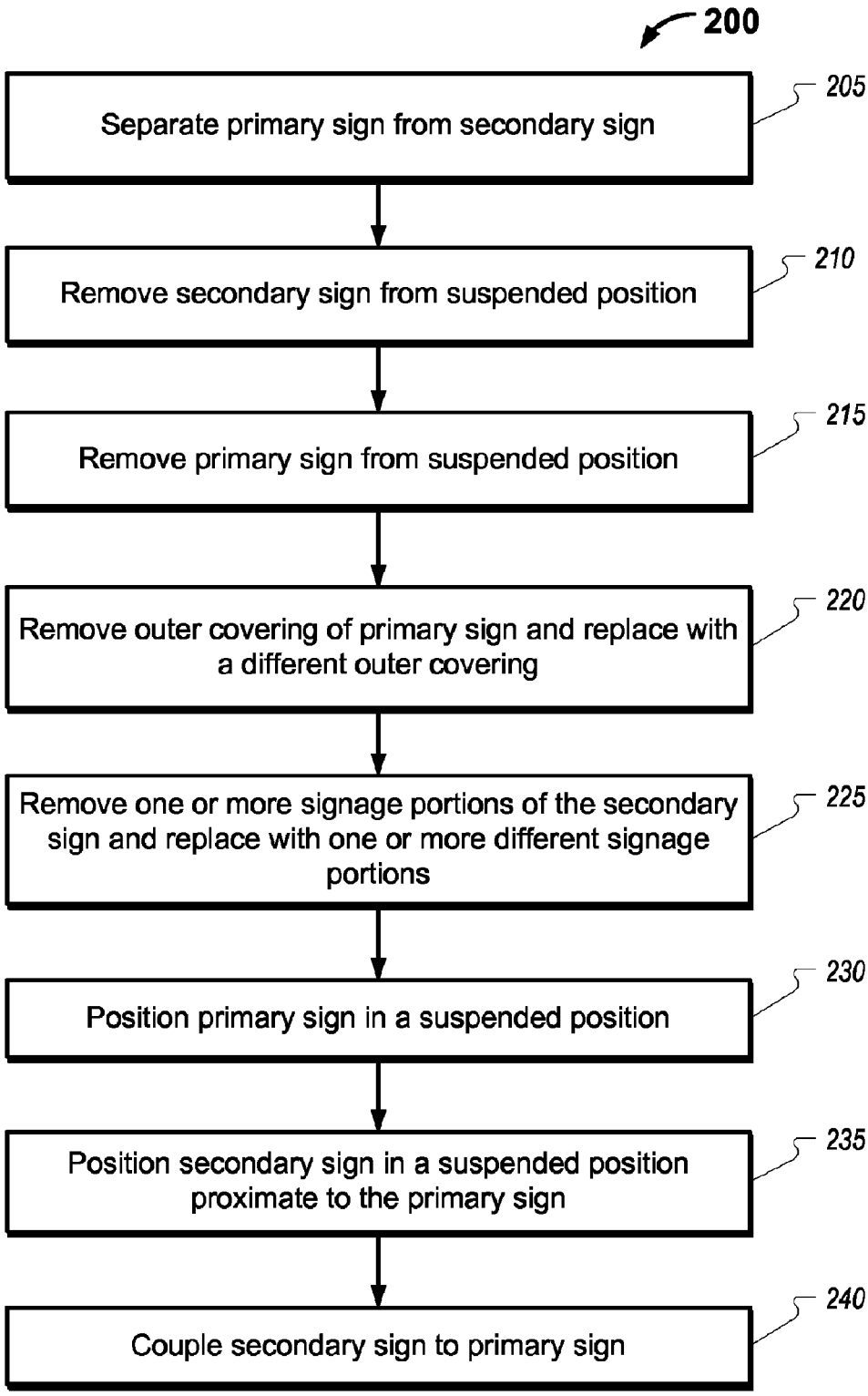
FIG. 6 is a chart of a process for using a display apparatus, in accordance with some embodiments.

Referring now to FIG. 6, some embodiments of a process 200 for altering the appearance of a display apparatus include an operation 205 of separating a primary sign from a secondary sign of a display apparatus. In one example, the first sign 110 (as shown in FIG. 1) is the primary sign, and the second sign 130 (also shown in FIG. 1) is the secondary sign. A store worker separates the second sign 130 from the first sign 110 by withdrawing the side edge portion 140 of the second sign 130 from the channels 124*a-b* disposed within the open side face 120 of the first sign 110. As such, the second sign 130 is configured to be toollessly removed from the first sign 110 while the first sign 110 remains suspended from the ceiling. In some embodiments, the second sign 130 is held in the channels 124*a-b* by a friction fit, and the second sign 130 is removed from the open side face 120 of the first sign 110 by a sliding motion of the side edge portion 140 away from the channels 124*a-b*.

In operation 210, a user removes the secondary sign from a suspended position. For example, the store worker can use a ladder to reach the display apparatus 100 (as shown in FIG. 1) when it is suspended in an operative position. The store worker removes the second sign 130 (also shown in FIG. 1) from the suspension members 102 and places the second sign 130 on the ground, a shelf, a support device, or in another location accessible while standing on the ground. In some instances, the second sign 130 is removed from the suspension members 102 by unhooking the mounting portions 146 from hooks disposed at the end of the suspension members 102.

In operation 215, a user removes the primary sign from a suspended position. In one example, the store worker can use the ladders to access the first sign 110 (as shown in FIG. 1) when it is suspended in an operative position. The store worker removes the first sign 110 from the suspension members 102. The first sign 110 is then placed on the ground, a shelf, a support device, or in another location accessible while standing on the ground. In some instances, the first sign 110 is removed from the suspension members 102 by unhooking the mounting portions 126 from hooks disposed at the end of the suspension members 102. In some alternate embodiments in which the display apparatus 100 includes light sources for providing a backlit effect for the first sign 110, removing the first sign 110 from a suspended position further includes detaching the light sources from a power source (e.g. unplugging a power cable of the light sources) or detaching the light sources from the first sign 110.

In these embodiments of the process 200 in which the primary sign and secondary sign are separated before removing the primary and secondary signs from their suspended positions, an individual store worker can readily change the appearance of the display apparatus 100 because the individual store worker optionally manipulates the signs 110 and 130 one at a time rather than attempting to remove the signs 110 and 130 from the suspension members 102 while the signs 110 and 130 are still attached to one another.

In some alternate embodiments of the process 200, the steps of removing the secondary sign and the primary sign from suspended positions are performed in reverse order. Also, in other embodiments of the process 200, the step of separating the secondary sign from the primary sign is performed after the step of removing the primary and secondary signs from a suspended position.

Still referring to FIG. 6, in operation 220 of the process 200, the user removes an outer covering of the primary sign and replaces the outer covering with a different outer covering. For example, the web of material 114 (as shown in FIG. 1) wrapped around the first wire frame 112 of the first sign 110 includes graphics and texts related to a first set of products. In this example, a store worker toollessly removes the web of material 114 from the wire frame 112 by unzipping the zipper 118 and removing the web of material 114. The store worker then retrieves a replacement web of material which includes different graphics and texts related to a different set of products or otherwise providing a different appearance. The store worker wraps the replacement web of material around the first wire frame 112 and uses a zipper, buttons, or snaps of the second web of material to secure the second web of material around the wire frame 112, thus changing the appearance of the first sign 110. As another example, the store worker toollessly removes the web of material 114 from the wire frame 112 by sliding the web of material 114 over one of the sides of the wire frame 112 (e.g. the side 120 or the side 121). The store worker then slides the replacement web of material over one of the sides of the wire frame 112 until the second web of material is in an operative position on the wire frame 112. In such instances, the web of material 114 and the replacement web of material do not require zippers, buttons, snaps, hooks, or other fasteners in order to be removed from or attached to the wire frame 112.

In operation 225, the user removes one or more signage portions of the secondary sign and replaces the one or more signage portions with one or more different signage portions. For example, a store worker removes one, some, or all of the webs of material 134*a-c* from the frame portions 144*a-c* of the second wire frame 132 (as shown in FIG. 1). In some embodiments, the webs of material 134*a-c* are toollessly removed from the wire frame 132 by disengaging (e.g. unwrapping) the finger extensions 135*a-c* of the webs of material 134*a-c* from horizontal arms of the wire frame 132. In some instances, the webs of material 134*a-c* are removed by loosening fasteners used to attach the webs of material 134*a-c* to the wire frame 132. As another example, the webs of material 134*a-c* are removed from the wire frame 132 by releasing a removable adhesive or two sided tape from the finger extensions 135*a-c*. Once the store worker has removed one or more of the webs of material 134*a-c*, the store worker attaches one or more replacement webs of material to the wire frame 132 in order to change the appearance of the second sign 130. For example, the webs of material 134*a-c* display graphics that are displayed on clothing items located near the display apparatus 100 when the display apparatus is suspended in an operative position. The webs of material 134*a-c* are removed and replaced with replacement webs of material that display graphics representing a different set of clothing items or otherwise having a different appearance. In some instances, images and text displayed by the different signage portions affixed to the secondary sign correspond to images and text displayed by the different outer covering that is affixed to the primary sign in operation 220. In some embodiments, the replacement webs of material include finger extensions (similar to finger extensions 135*a-c* shown in FIG. 1) configured to wrap around horizontal arms of the wire frame 132 and hold the different webs of material in a generally taut condition between the frame portions 144*a-c* of the wire frame 132

In operation 230, the user positions the primary sign in a suspended position. For example, one or more store workers lift the first sign 110 (having the replacement web of material) toward the ceiling and attach the first sign 110 to the suspension members 102. In some instances, the first sign 110 is attached to the suspension members 102 by attaching hooks disposed at the end of the suspension members 102 to the mounting portions 126 of the wire frame 112. In some embodiments, the suspension members 102 are attached to the wire frame 112 using fasteners. In some embodiments, the first sign 110 is suspended from the ceiling track 104 using rope, string, chains, rods, or ribbons. In some alternate embodiments in which the display apparatus 100 includes light sources for providing a backlit effect for the first sign 110, positioning the first sign 110 in a suspended position further includes coupling the light sources to a power source (e.g. plugging in a power cable of the light sources) or attaching the light sources to the first sign 110.

In operation 235, the user positions the secondary sign in a suspended position. For example, one or more store workers use one or more ladders to lift the second sign 130 (having the replacement webs) toward the ceiling and attach the second sign 130 to the suspension members 102. In some instances, the second sign 130 is attached to the suspension members 102 by attaching hooks disposed at the end of the suspension members 102 to the mounting portions 146 of the wire frame 132. In some embodiments, the suspension members 102 are attached to the wire frame 132 using fasteners. In some embodiments, the second sign 130 is suspended from the ceiling track 104 using rope, string, chains, rods, or ribbons.

Figure 2:
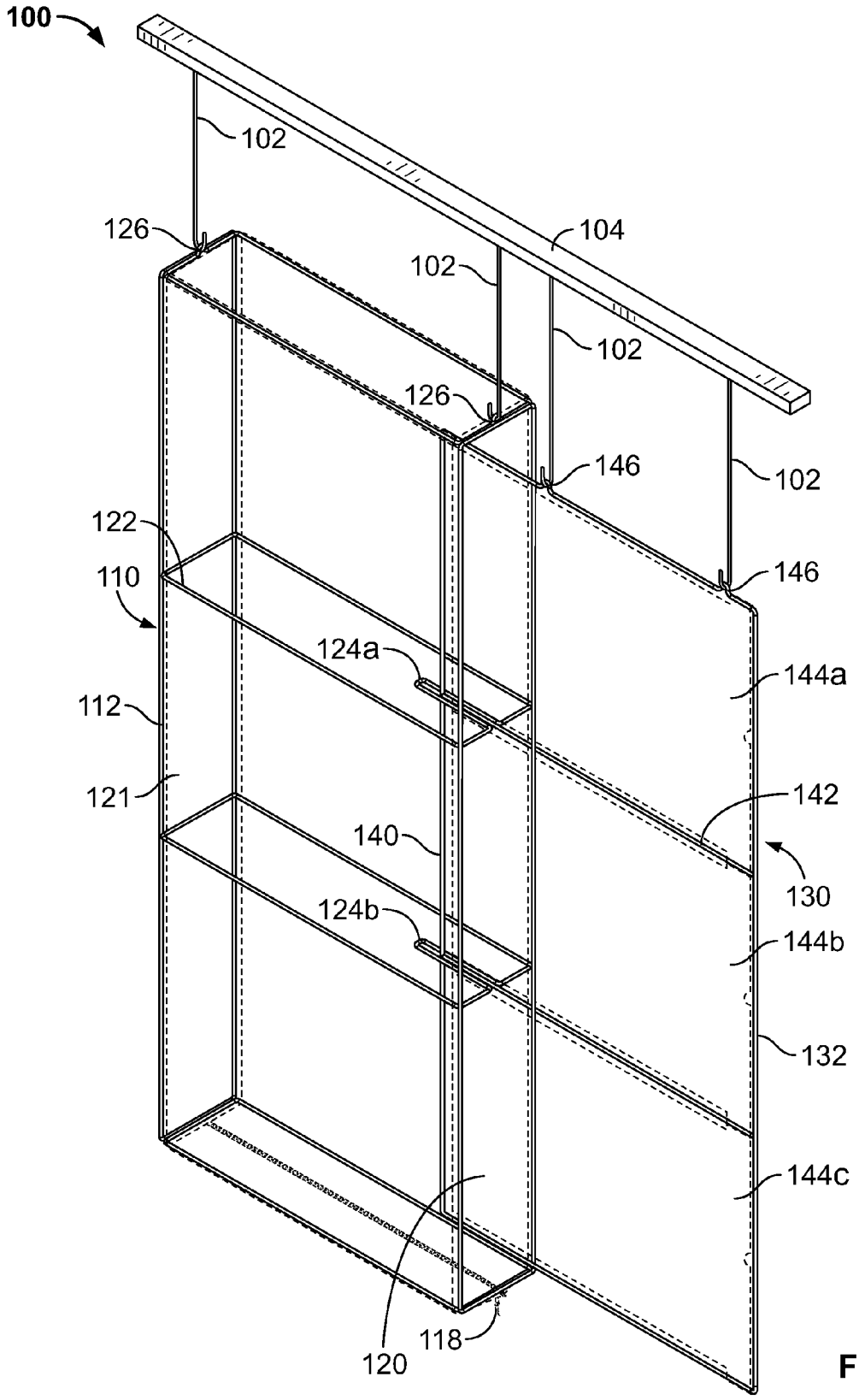
FIG. 2 is a perspective view of a portion of the display apparatus of FIG. 1.
Figure 3:
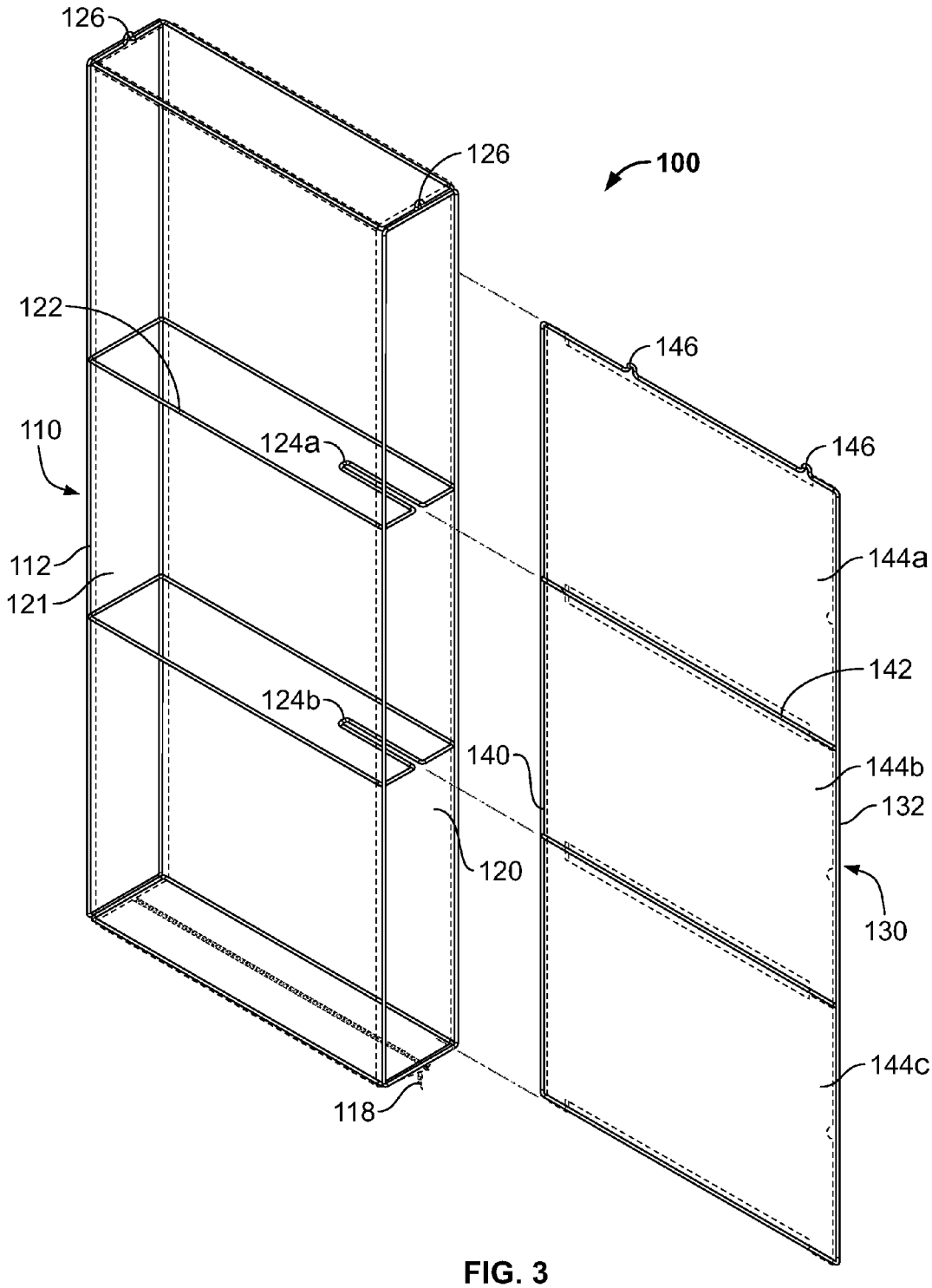
FIG. 3 is an exploded view of the portion of the display apparatus of FIG. 2.
Figure 4:
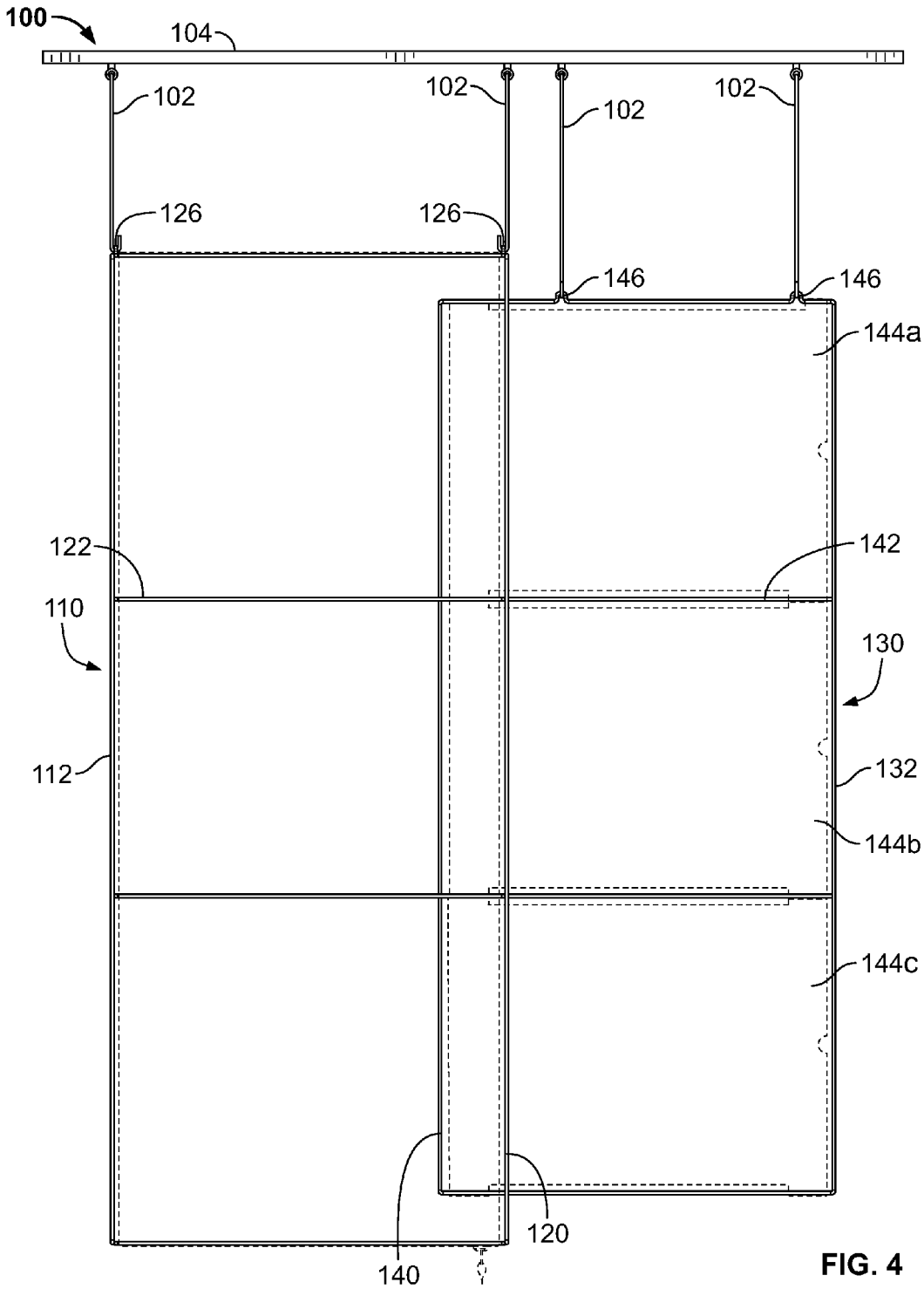
FIG. 4 is a front view of the portion of the display apparatus of FIG. 2.
Figure 5:
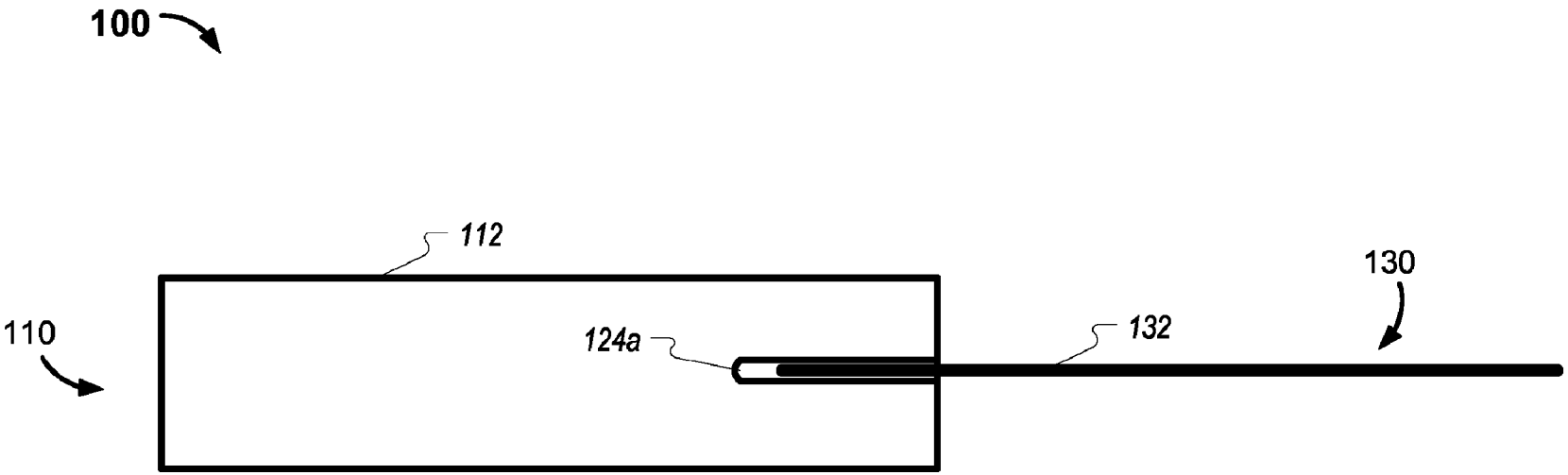
FIG. 5 is a top view of the portion of the display apparatus of FIG. 2.

In operation 240, the user couples the secondary sign to the primary sign. For example, as shown in FIG. 2, the side edge portion 140 of the second sign 130 is inserted into the channels 124*a-b* disposed within the open side face 120 of the first sign 110. In some instances, fasteners are used to secure the second sign 130 to the first sign 110 once the side edge portion 140 is in an operative position with respect to the u-shaped channels 124*a-b* of the first sign 110. In some instances the channels 124*a-b* form a friction fit with the side edge portion 140 of the second sign 130.

Accordingly, the process 200 provides a user with opportunity to toollessly remove the first and second signs, change the appearance of one or both signs, and thereafter install the first and second signs in the ceiling-mounted position. In such embodiments, both the first and second signs can be toollessly mounted to a ceiling of a retail store environment so as to draw consumers' attention toward the primary and secondary sign surfaces on multiple planes.

A number of embodiments of the invention have been described. Nevertheless, it will be understood that various modifications may be made without departing from the spirit and scope of the invention. Accordingly, other embodiments are within the scope of the following claims.

What is claimed is:

1. A ceiling-mounted sign apparatus comprising:

a first sign suspended from a ceiling and having a wire frame structure that defines a generally three-dimensional shape and an interior space accessible by an open side face, the first sign including a web of material toollessly mounted to the wire frame structure so as to substantially cover front and rear faces defined by the wire frame structure, the web of material including at least one ink layer providing indicia on an outer face of the web of material; and a second sign suspended from the ceiling, the second sign having a front-to-rear thickness that is substantially less than a front-to-rear thickness of the first sign, the second sign including a side edge portion that is recessed into the open side face of the first sign, wherein the wire frame structure of the first sign comprises means for releasably retaining the side edge portion of the second sign in an operative position when the side edge portion is recessed into the open side face of the first sign, the side edge portion of the second sign being toollessly removable from the releasably retaining means.

2. The sign apparatus of claim 1, wherein the releasably retaining means comprises one or more channels coupled to the wire frame structure in the interior space of the wire frame structure, the side edge portion of the second sign being inserted into the one or more channels when the side edge portion is recessed into the open side face of the first sign.

3. The sign apparatus of claim 2, wherein the one or more channels are u-shaped channels defined by wire material of the wire frame structure of the first sign, each of the u-shaped channels extending away from the open side face of the first sign and into the interior space of the first sign.

4. The sign apparatus of claim 3, wherein the one or more channels slidably engage at least a portion of the second sign when the side edge portion of the second sign is inserted into the one or more channels.

5. The sign apparatus of claim 1, wherein the web of material of the first sign wraps around the wire frame structure of the first sign so as to substantially cover the front face, a top face, the rear face, and a bottom face defined by the wire frame structure.

6. The sign apparatus of claim 5, wherein the web of material comprises: a fabric material having the at least one ink layer formed thereon, and a zipper device coupled to free ends of the fabric material so as to couple together and form a loop.

7. The sign apparatus of claim 1, wherein the second sign comprises a second wire frame structure that defines a generally two-dimensional shape and one or more secondary webs of material toollessly mounted to the second wire frame structure, each of the one or more secondary webs of material having an ink layer providing indicia thereon.

8. The sign apparatus of claim 7, wherein a height and a depth of the wire frame structure of the first sign are substantially greater than a height and a depth of the second wire frame structure of the second sign.

9. A display sign apparatus for a retail store environment, comprising:

a primary sign including a first frame that defines an internal space accessible by a side opening, the primary sign including a flexible printed covering toollessly mounted to the first frame so as to substantially cover front and rear faces defined by the first frame while maintaining the accessibility of the internal space through the side opening;

a first set of suspension members coupling the first frame of the primary sign to a ceiling of a retail store environment, the first set of suspension members being toollessly mounted to the first frame of the primary sign;

a secondary sign including a second frame and a plurality of signage portions releasably mounted to the second frame, the second frame having a thickness that is substantially less than a front-to-rear depth dimension of the side opening of the primary sign, and the second frame having a height that is substantially less than a top-to-bottom height dimension of the side opening of the primary sign; and a second set of suspension members coupling the second frame of the secondary sign to the ceiling of the retail store environment, the second set of suspension members being toollessly mounted to the second frame of the secondary sign, wherein the second set of suspension members arrange the secondary sign in an operative position relative to the primary sign so that a side section of the secondary sign extends through the side opening of the primary sign and into the internal space of the primary sign, wherein the secondary sign is retained by the first frame of the primary sign so that a front display face of the secondary sign remains generally parallel to, and spaced at a depth away from, a front display face of the primary sign.

10. The apparatus of claim 9, wherein the first frame of the primary sign defines at least one channel to releasably retain the side section of the secondary sign that extends through the side opening of the primary sign.

11. The apparatus of claim 10, wherein the at least one channel is defined by wire material of the first frame of the primary sign, wherein the side section of the secondary sign slidably engages the wire material of the first frame when the side section of the secondary sign extends through the side opening of the primary sign.

12. The apparatus of claim 9, wherein the flexible printed covering of the primary sign comprises a web of material that wraps around the first frame of the primary sign so as to substantially cover the front face, a top face, the rear face, and a bottom face defined by the first frame while not covering the side opening.

13. The apparatus of claim 12, wherein the web of material comprises: a fabric material having at least one ink layer formed thereon, and a zipper device coupled to free ends of the fabric material so as to couple together and form a loop.

14. The sign apparatus of claim 9, wherein the first frame of the primary sign comprises a first wire frame structure that generally defines a rectangular prism shape, wherein the second frame of the secondary sign comprises a second wire frame structure that generally defines a rectangle shape, the rectangle shape of the secondary sign being smaller than the rectangular prism shape of the primary sign.

15. The sign apparatus of claim 9, wherein the first and second sets of suspension members comprise flexible wires that extend from a ceiling-mounted track and comprise hooks to engage with mounting portions of the first and second frames.

16. A method of using a sign apparatus, comprising:

providing a first display sign including: an internal structure that defines a generally three-dimensional shape accessible through an open side face, a first web of material toollessly mounted to the internal structure so as to substantially cover front and rear faces defined by the internal structure, and first mounting portions to toollessly engage with a first set of ceiling suspension members;

mounting the first display sign to the first set of ceiling suspension members so that the first display sign is arranged proximate to a ceiling in a retail store environment;

providing a second display sign having a front-to-rear dimension that is substantially less than a front-to-rear dimension of the first display sign, the second display sign including one or more secondary webs of material mounted to a second structure and second mounting portions to toollessly engage with a second set of ceiling suspension members; and mounting the second display sign to the second set of ceiling suspension members so that the second display sign is arranged proximate to the ceiling in the retail store environment, wherein the second display sign is arranged so that a side edge portion of the second display sign is recessed into the open side face of the first display sign and releasably retained in an operative position therein.

17. The method of claim 16, further comprising:

separating the first display sign from the second display sign while the first display sign is suspended from the ceiling in the retail store environment;

lowering the first display sign toward the ground surface;

toollessly removing the first web of material from the internal structure of the first display sign; and toollessly mounting a replacement web of material to the internal structure of the first display sign.

18. The method of claim 17, further comprising:

raising the first display sign to a suspended position proximate to the ceiling; and releasably retaining the side edge portion of the second display sign in the open side face of the first display sign.

19. The method of claim 17, further comprising:

lowering the second display sign toward a ground surface after separating the first display sign from the second display sign;

toollessly removing at least one of the secondary webs of material from the second structure of the second display sign; and toollessly mounting a replacement secondary web of material to the second structure of the second display sign.

20. The method of claim 19, further comprising raising the second display sign to a suspended position proximate to the ceiling so that the side edge portion of the second display sign extends into the open side face of the first display sign.

* * * * *